United States Patent [19]

Nishio et al.

[11] 3,964,276

[45] June 22, 1976

[54] KNITTING ERROR DETECTING APPARATUS FOR CIRCULAR KNITTING MACHINE

[75] Inventors: Osamu Nishio, Nagoya; Nokihisa Adachi, Kasugai, both of Japan

[73] Assignee: Okuma Machinery Works, Ltd., Nagoya, Japan

[22] Filed: Sept. 3, 1975

[21] Appl. No.: 610,086

[52] U.S. Cl. ..... 66/154 A; 340/248 P; 340/267 R

[51] Int. Cl.[2] ..... D04B 15/88

[58] Field of Search ..... 66/154 A, 157; 340/248 P, 267 R, 248 R

[56] References Cited

UNITED STATES PATENTS

| | | | |
|---|---|---|---|
| 3,120,663 | 2/1964 | Beaman et al. | 340/248 A |
| 3,313,128 | 4/1967 | Schmidt et al. | 66/154 A |
| 3,313,129 | 4/1967 | Stock | 66/154 A |
| 3,680,331 | 8/1972 | Morat | 66/50 |
| 3,852,731 | 12/1974 | Hollands | 340/248 P |

FOREIGN PATENTS OR APPLICATIONS

| | | | |
|---|---|---|---|
| 2,055,100 | 8/1971 | Germany | 66/154 A |

*Primary Examiner*—Ronald Feldbaum
*Attorney, Agent, or Firm*—Jay L. Chaskin

[57] ABSTRACT

A circular knitting machine having a device for electronically issuing a pattern-forming command is provided with a needle selection verification pulse detector. The needle selection verification pulse detector produces a needle selection verification pulse $B_1$ in response to a needle-selecting coil exciting-voltage B affected by a pulse induced in a needle-selecting coil and to a needle-selecting coil command voltage A not affected by the pulse thus induced when a needle selector in a needle-selecting system moves. When the presence or absence of the command voltage A does not coincide with the presence or absence of the verification pulse $B_1$ respectively, occurrence of a knitting error is immediately detected.

3 Claims, 4 Drawing Figures

KNITTING ERROR DETECTING APPARATUS FOR CIRCULAR KNITTING MACHINE

BACKGROUND OF THE INVENTION

1. Field of the Invention

This invention relates to a knitting error detecting apparatus for the circular knitting machine, or more in particular to a knitting error detecting apparatus for the circular knitting machine having a pattern-forming command circuit.

2. Description of the Prior Art

In conventional circular knitting machines electronically forming patterns, the operator himself decides by checking the produced fabric whether or not it has been knitted in accordance with a command issued from a control device. In such a method, fabric of a considerable length, say 0.5 m has already been knitted before a knitting error is discovered, and therefore substandard fabric is likely to continue to be knitted undesirably during the process of error discovery. Also, a knitting error which otherwise might involve only a small portion often results in a considerable amount of inferior knitted fabric due to a delayed discovery of the error.

SUMMARY OF THE INVENTION

Accordingly, it is an object of the present invention to discover and detect a knitting error immediately after its occurrence.

Another object of the invention is to prevent production of substandard fabric which otherwise might occur due to a knitting error.

The gist of the invention will be described below. The circular knitting machine according to the invention is provided with a command circuit for processing a pattern signal of a desired knitting pattern. The pattern signal processed in the command circuit is applied to a needle-selecting system located in opposition to each yarn feeder aperture on the periphery of a cylinder thereby to effect a pattern-forming knitting operation. The apparatus according to the invention further comprises a needle selection verification pulse detector to which a needle-selecting coil-exciting voltage B and a needle-selecting coil command voltage A are applied. The needle-selecting coil-exciting voltage B, which is the pattern signal processed as above, is affected by the pulses induced in the needle-selecting coil when the needle selector in the needle selecting system moves. The needle-selecting coil command voltage A, on the other hand, has the same value as the exciting voltage B but is not affected by the pulse components induced in the needle selecting coil. In response to these two inputs, the needle selection verification pulse detector produces a needle selection verification pulse $B_1$ which is the pulse component induced in the needle-selecting coil when the needle selector in the needle-selecting system moves. A knitting error is indicated, when the presence or absence of the needle selecting coil command voltage A does not coincide with the presence or absence of the needle selection verification pulse $B_1$, respectively.

DESCRIPTION OF THE PREFERRED EMBODIMENTS

Figure 1:
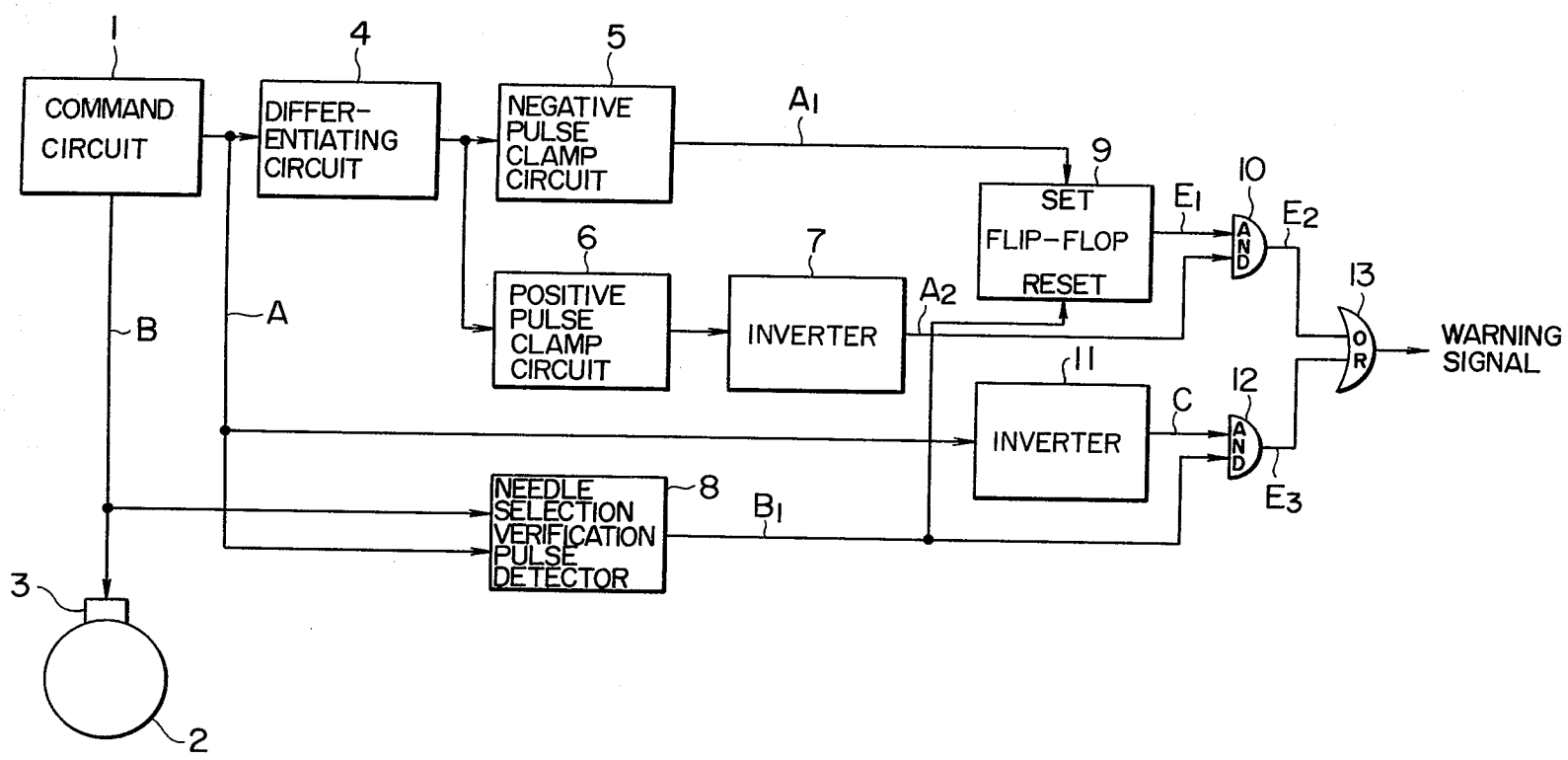
FIG. 1 is a block diagram showing an embodiment of the present invention.
Figure 2:
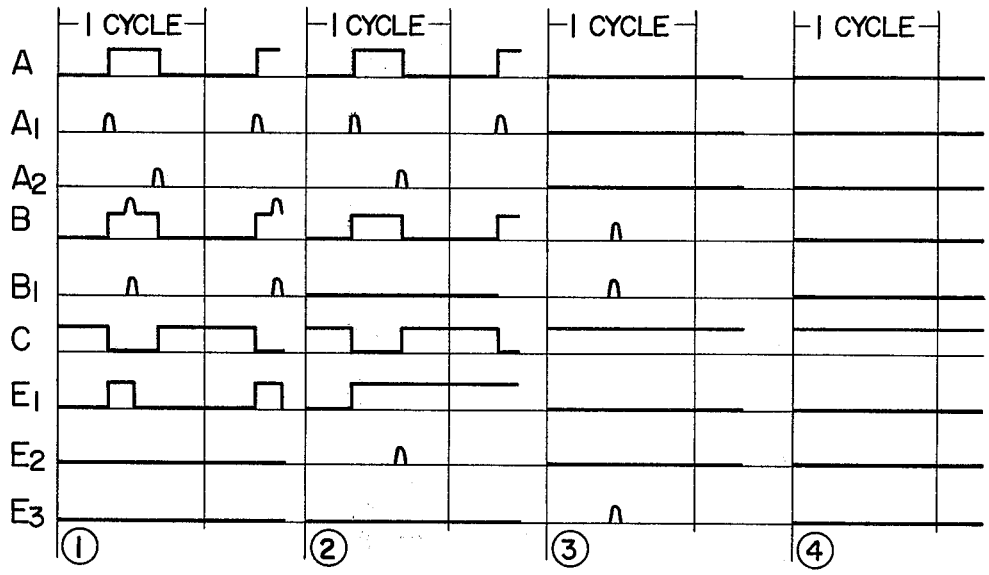
FIG. 2 is a diagram showing input and output waveforms at various parts of the circuit of FIG. 1.

Referring to FIG. 1, reference numeral 1 shows a command-circuit for producing a needle-selecting coil-exciting voltage B and a needle-selecting coil command voltage A. The needle-selecting coil-exciting voltage B is affected by the pulse component induced in the needle selecting coil, while the needle-selecting coil command voltage A has the same value as the voltage B but is not affected by such a pulse component when the needle selector in the needle-selecting system moves. Numeral 2 shows a circular knitting machine proper, and numeral 3 the needle-selecting system of the circuit knitting machine proper 2. The needle-selecting system 3 is impressed with the needle-selecting coil-exciting voltage B from the command circuit 1 and includes the needle-selecting coil and the needle selector. In the event that the needle selector in the needle-selecting system responds to the needle-selecting coil-exciting voltage B applied thereto, an induced voltage is generated in the needle-selecting coil within the needle-selecting system. In this case, the needle-selecting coil-exciting voltage B itself takes a waveform including the induced voltage component as shown by B in column ① of FIG. 2. If the needle selector does not respond, however, no induced voltage is generated in the needle-selecting coil, and therefore the waveform B as shown in column ② of FIG. 2 is produced. Numeral 4 shows a differentiating circuit for differentiating the waveform of the needle-selecting coil command voltage A applied thereto from the command circuit 1. Numeral 5 shows a negative pulse clamp circuit for removing negative pulses from the output of the differentiating circuit 4. Numeral 6 shows a positive pulse clamp circuit for removing positive pulses from the output of the differentiating circuit 4. Numeral 7 shows an inverter for inverting the output of the positive pulse clamp circuit 6. Numeral 8 shows a needle selection verification pulse detector for producing a needle selection verification pulse $B_1$ in response to the needle-selecting coil-exciting voltage B and the needle-selecting coil command voltage A produced from the command circuit 1, wherein the needle-selecting coil command voltage A has the same value as the exciting voltage B but is not affected by the pulse component induced in the needle selecting coil. Numeral 9 shows a flip-flop for producing a signal $E_1$ when it is set. A set input signal to the flip-flop 9 is comprised of a needle-selecting coil command pulse $A_1$ produced from the negative pulse clamp circuit 5, while a reset input to the flip-flop 9 is comprised of the needle selection verification pulse $B_1$ produced from the needle selection verification pulse detector 8. Numeral 10 shows an AND circuit for producing a signal $E_2$ when impressed with the two inputs thereto; one being the output $E_1$ of the flip-flop 9, and the other of the needle-selecting coil command pulse $A_2$ produced from the inverter 7. Numeral 11 shows an inverter for producing a complement of the needle selecting-coil command voltage A produced from the command circuit 1, and this inverter 11 produces a waveform as shown in C of FIG. 2. Numeral 12 shows an AND circuit for producing a waveform $E_3$ in response to two inputs thereto; one being the output C from the inverter 11, and the other the needle selection verification pulse $B_1$ produced from the needle selection verification pulse detector 8. Numeral 13 shows an OR circuit to which the output $E_2$ from the AND circuit 10 and the output $E_3$ from the AND circuit 12 are applied. The output of the OR circuit makes up a warning signal.

The operation of the apparatus according to the invention having the above-mentioned construction will be explained with reference to the four cases (1) to (4) described below including two normal cases and two abnormal cases (involving a knitting error). Output waveforms produced from the component elements in these four cases are as shown in FIG. 2.

1. The case where the needle-selecting coil command voltage A is produced and the needle selector responds normally, that is to say, the case where both the needle selecting-coil command voltage A and the needle selection verification pulse $B_1$ are present:

The flip-flop 9 is set by the initial pulse $A_1$ of the needle selecting coil command pulse A, and produces signal $E_1$, which is in turn applied as one input to the AND circuit 10. When the needle selector in the needle-selecting system responds, however, the needle selection verification pulse $B_1$ is produced from the needle selection verification pulse detector 8 thereby to reset the flip-flop 9. The output $E_1$ of the flip-flop 9 becomes zero, and therefore the output $E_2$ remains zero even when the needle-selecting coil command pulse $A_2$ is applied as the other input to the AND circuit 10. Under this condition, the waveform C of one input to the AND circuit 12 is a complement of the needle-selecting coil command voltage A, so that the output $E_3$ of the AND circuit 12 is kept zero. As a result, no output is produced from the OR circuit 13. In other words, normal knitting operation is performed and no warning signal generated in case (1) under consideration.

2. The case where the needle selector does not respond in spite of the needle-selecting coil command voltage A being produced, that is to say, the case where the needle-selecting coil command voltage A is present and the needle selection verification voltage $B_1$ absent:

The flip-flop 9 is set by the initial pulse $A_1$ of the needle selecting-coil command pulse A, and produces signal $E_1$, which is in turn applied as one input to the AND circuit 10. Since the needle selector in the needle-selecting system does not respond, the needle-selecting coil-exciting voltage B does not include the induced pulse $B_1$, and therefore the needle selection verification pulse $B_1$ is not produced from the needle selection verification pulse detector 8. Therefore the flip-flop 9 is not reset and continues to produce the output $E_1$. The AND circuit 10 produces the signal $E_2$ when the needle-selecting coil command pulse $A_2$ is applied as the other input thereto. In this case, the output $E_3$ of the AND circuit 12 is kept zero as in the case (1) above. Since the signal $E_2$ is produced from the AND circuit 10, a warning signal is produced from the OR circuit 13, thus informing the operator that a knitting error has been committed.

3. The case where the needle selector moves erroneously energized in spite of the absence of the needle-selecting coil command voltage A, that is, the case where the needle-selecting coil command voltage A is absent, while the needle selection verification pulse $B_1$ is present:

Since there is no needle-selecting coil command voltage A produced, neither the needle-selecting coil command pulse $A_1$ nor the needle-selecting coil command pulse $A_2$. Therefore, the output $E_1$ of the flip-flop 9 is also kept zero, and so is the output $E_2$ of the AND circuit 10. On the other hand, the needle-selecting coil command votage A which is zero is inverted by the inverter 11, and the output C in the state of "1" is produced from the inverter 11 and applied as one input to the AND circuit 12. In view of the fact that the needle selector in the needle-selecting system moves erroneously energized, the needle selection verification pulse $B_1$ is produced from the needle selection verification pulse detector 8. At the same time, the output $E_3$ is produced from the AND circuit 12 and applied through the OR circuit 13, thus generating a warning signal indicating a knitting error.

Figure 3A:
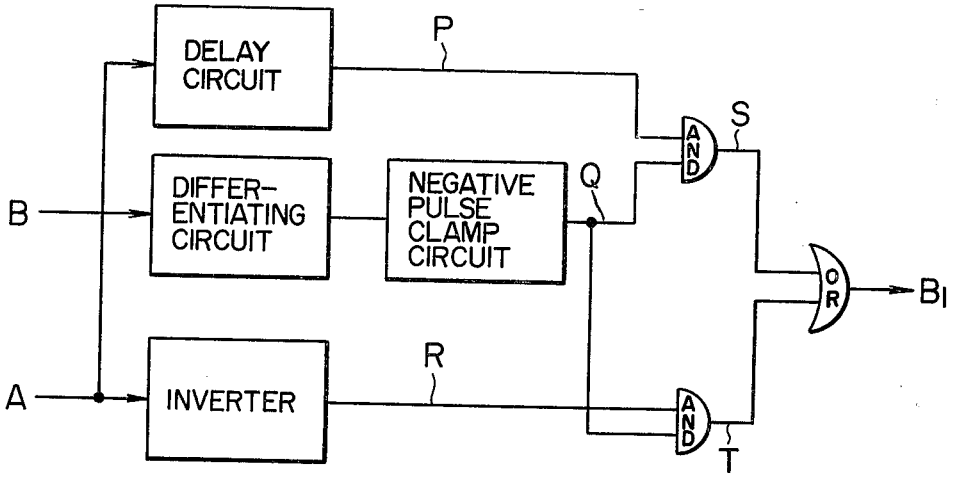
FIG. 3*a* shows an example of the circuit of the needle selection verification pulse detector 8 shown in FIG. 1.
Figure 3B:
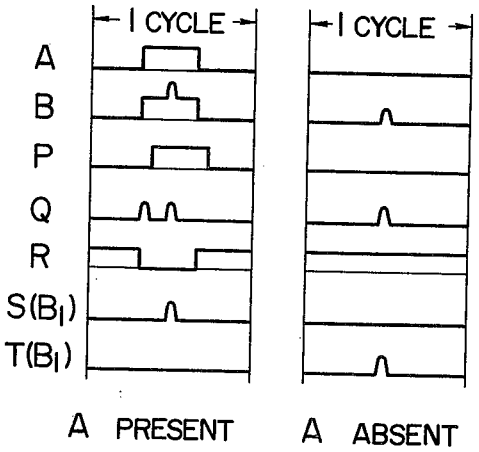
FIG. 3*b* is a diagram showing input and output waveforms at various parts of the circuit of FIG. 3*a*.

4. The normal case where the needle selector does not move in the absence of the needle selecting coil command voltage A, that is, the case where neither the needle-selecting coil command voltage A nor the needle selection verification pulse $E_1$ is present:

In this case, the output $E_2$ of the AND circuit 10 is kept zero as in case (3) above. Since the needle selection verification pulse $B_1$ making up an input to the AND circuit 12 is not produced, on the other hand, the output $E_3$ of the AND circuit 12 is also kept zero. As a result, no output is produced from the OR circuit 13. In other words, this case involves a normal knitting operation and therefore no warning signal is generated. Incidentally, the needle selection verification pulse detector 8 may comprise an differential amplifier or alternatively a circuit as shown in FIG. 3a including a delay circuit, a differentiating circuit and an inverter. In the last-mentioned case, the needle-selecting coil command voltage A is applied to the inverter and the delay circuit, which respectively produce outputs R and P. These outputs R and P are applied as a first input to the first AND circuit and a first input to the second AND circuit, respectively. The needle-selecting coil-exciting voltage B affected by the pulse induced in the needle-selecting coil, on the other hand, is applied to the differentiating circuit and further to the negative pulse clamp circuit, the output Q of which is introduced to the second input of the first AND circuit and the second input of the second AND circuit. The outputs T and S of the first and second AND circuit are respectively applied to the OR circuit, the output of which is connected to a warning device. The waveforms of FIG. 3b show those produced from the respective parts of the circuit when the needle selector moves in the presence and absence of the needle selecting coil command voltage A.

According to the present invention, a knitting error is automatically detected and indicated, when the needle selector does not respond in the presence of the needle-selecting coil command voltage A, or when the needle selector moves erroneously energized in the absence of the command voltage A.

We claim:

1. In a circular knitting machine comprising a command circuit for processing a pattern signal for a desired knitting pattern and a needle selecting system disposed in opposition to each yarn feeder on the periphery of a cylinder, said pattern signal being applied to said needle-selecting system after being processed by said command circuit thereby accomplishing a pattern-forming knitting operation while: a knitting error-detecting apparatus comprising a needle selection verification pulse detector impressed with a needle-selecting coil-exciting voltage B and a needle-selecting coil command voltage A and producing a needle selection verification pulse $B_1$, said needle-selecting coil-exciting voltage B making up said pattern signal and being affected by a pulse component induced in a needle-selecting coil when a needle selector in said needle selecting system moves, said needle-selecting coil command voltage A having the same value as said exciting voltage B but being not affected by said pulse component induced in said needle selecting coil, said needle selection verification pulse $B_1$ being a pulse component induced in said needle-selecting coil by the movement of said needle selector in said needle-selecting system, said apparatus indicating a knitting error when the presence and absence of said needle-selecting coil command voltage A does not coincide with the presence and absence of said needle selection verification pulse $B_1$ respectively.

2. A knitting error-detecting apparatus for the circular knitting machine according to claim 1, wherein said needle-selecting coil command voltage A produced from said command circuit is applied through a differentiating circuit, through a negative pulse clamp circuit, to a set input of a flip-flop, said needle-selecting coil command voltage A is applied to a first input terminal of a needle selection verification pulse detector and to a first inverter, said differentiating circuit has part of the output thereof applied through a positive pulse clamp circuit, through a second inverter to a first input terminal of a first AND circuit, said needle-selecting coil-exciting voltage B affected by said pulse induced in said needle-selecting coil is applied to a second input terminal of said needle selection verification pulse detector, the output of said detector is applied to a reset input terminal of said flip-flop and a first input terminal of a second AND circuit, the outputs from said flip-flop and said first inverter are applied to a second input terminal of said first AND circuit and to a second input terminal of said second AND circuit respectively, the output of said first and second AND circuits are applied to an OR circuit, and the output of said OR circuit is applied to a warning device.

3. A knitting error detecting apparatus for the circular knitting machine according to claim 1, wherein said needle selection verification pulse detector includes an inverter and delay circuit impressed with said needle-selecting coil command voltage A, and a differentiating circuit impressed with said needle-selecting coil-exciting voltage B affected by said pulse induced in said needle-selecting coil, the outputs of said inverter and said delay circuit are applied to said first input terminal of said first AND circuit and to said first input terminal of said second AND circuit respectively, the output of said differentiating circuit is applied through said negative pulse clamp circuit to said second input terminal of said first AND circuit and to said second input terminal of said second AND circuit, the outputs of said first and second AND circuits are applied to an OR circuit, and the output of said OR circuit is applied to a warning device.

* * * * *